US005867974A

United States Patent [19]

Schmid

[11] Patent Number: 5,867,974

[45] Date of Patent: Feb. 9, 1999

[54] OPENING DEVICE FOR AN OPEN-END SPINNING MACHINE

[75] Inventor: Friedbert Schmid, Bad Überkingen, Germany

[73] Assignee: Spindelfabrick Suessen, Schurr, Stahlecker & Grill GmbH, Suessen, Germany

[21] Appl. No.: 963,868

[22] Filed: Nov. 4, 1997

[30] Foreign Application Priority Data

Nov. 11, 1996 [DE] Germany ..... 196 51 417.7

[51] Int. Cl.[6] ..... D01H 4/00

[52] U.S. Cl. ..... 57/408; 57/98; 57/99; 57/301; 57/304

[58] Field of Search ..... 57/301, 304, 406, 57/408, 411, 413; 19/98, 99

[56] References Cited

U.S. PATENT DOCUMENTS 3,800,520 4/1974 Schiltknecht ..... 57/58.91
5,465,567 11/1995 Schmolke et al. ..... 57/408

FOREIGN PATENT DOCUMENTS 436754 7/1991 European Pat. Off. ..... 57/408
93/02238 2/1993 WIPO ..... 57/408

*Primary Examiner*—William Stryjewski
*Attorney, Agent, or Firm*—Evenson McKeown Edwards & Lenahan, PLLC

[57] ABSTRACT

In the case of an opening device for an open-end spinning machine, the rotating opening roller is arranged in a housing with a prevailing vacuum and has one front side which is exposed to the free atmosphere. In the area of this front side the opening roller is sealed off against the housing by means of a labyrinth seal. The labyrinth seal starts in the area of a peripheral combing structure of the opening roller with a first sealing gap and ends with a second sealing gap in the free atmosphere. The sealing gaps are formed by cylindrical collar surfaces of the opening roller and corresponding hollow cylindrical countersurfaces of the housing. In addition, the collar surfaces are provided with fly repulsing notches, whose direction of effect is such that the fly is repulsed at the first sealing gap towards the combing structure and at the second sealing gap, repulsed towards the free atmosphere. The front side of the open roller exposed to the free atmosphere is not covered by a lid.

18 Claims, 4 Drawing Sheets

OPENING DEVICE FOR AN OPEN-END SPINNING MACHINE

BACKGROUND AND SUMMARY OF THE INVENTION

This application claims the priority of German application 196 51 417.7 filed in Germany on Nov. 11, 1996, the disclosure of which is expressly incorporated by reference herein.

The present invention relates to an opening device for open-end spinning machines comprising an opening roller which rotates in a housing under a vacuum and which is sealed from the housing in the area of a front side exposed to the free atmosphere by means of a labyrinth seal. The labyrinth seal starts in the area of a peripheral combing means of the opening roller with a sealing gap in the form of an annular clearance and ends with a second sealing gap arranged at a distance from the first sealing gap, said second sealing gap being connected directly to the free atmosphere and taking the form of an annular clearance, whereby these sealing gaps are formed by a first and second cylindrical collar surface of the opening roller and corresponding hollow cylindrical countersurfaces of the housing.

In the case of an opening device of this type (U.S. Pat. No. 3,800,520, FIG. 6), the sealing gaps of the labyrinth seal permit a certain small amount of air to flow from the atmosphere to the combing structure. As, however, experience has shown, single fibers tend, in the area at the open atmosphere and also in the area of the combing structure, to penetrate from the outside into the labyrinth seal and therefore there is the risk that the labyrinth seal may become blocked with fly accumulation after a time. The opening roller must then be stopped, disassembled and cleaned.

It is an object of the present invention to avoid this disadvantage to a large extent and to create an opening device wherein the fly accumulation is to a large extent kept away from the labyrinth seal.

This object has been achieved in accordance with the present invention in that the first collar surface arranged at the first sealing gap and the second collar surface arranged at the second sealing gap are provided with fly-repulsing notches, whose direction of effect is directed away from the labyrinth seal.

In particular, the direction of effect of the notches of the first collar surface is towards the combing structure and the direction of effect of the notches of the second collar surface is towards the open atmosphere. This results in the fly coming from the combing structure being knocked back again to the combing means and the fibers which are found flying around in the open atmosphere are returned thereto.

The fly-repulsing notches themselves take the form of grooves extending diagonally to the rotational direction of the opening roller, and have—in cross section—a striker surface on each side facing away from the rotational direction, which striker surface extends radially to the opening roller. For reasons of redressing the state of unbalance, a plurality of notches, preferably three or four, are arranged on each collar surface. In order that the sealing effect of the labyrinth seal is increased, the first and second collar surfaces comprising the notches have differing diameters. Hereby it can be provided that the first and second sealing gaps are separated by at least one expansion chamber in the form of an annular chamber.

In an advantageous embodiment of the present invention, the first and the second collar surfaces are arranged on the same component, which can be separated from the opening roller. This component is, for example, a tension disc, with which a ring, comprising the combing structure, is slid onto a base body of the opening roller.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
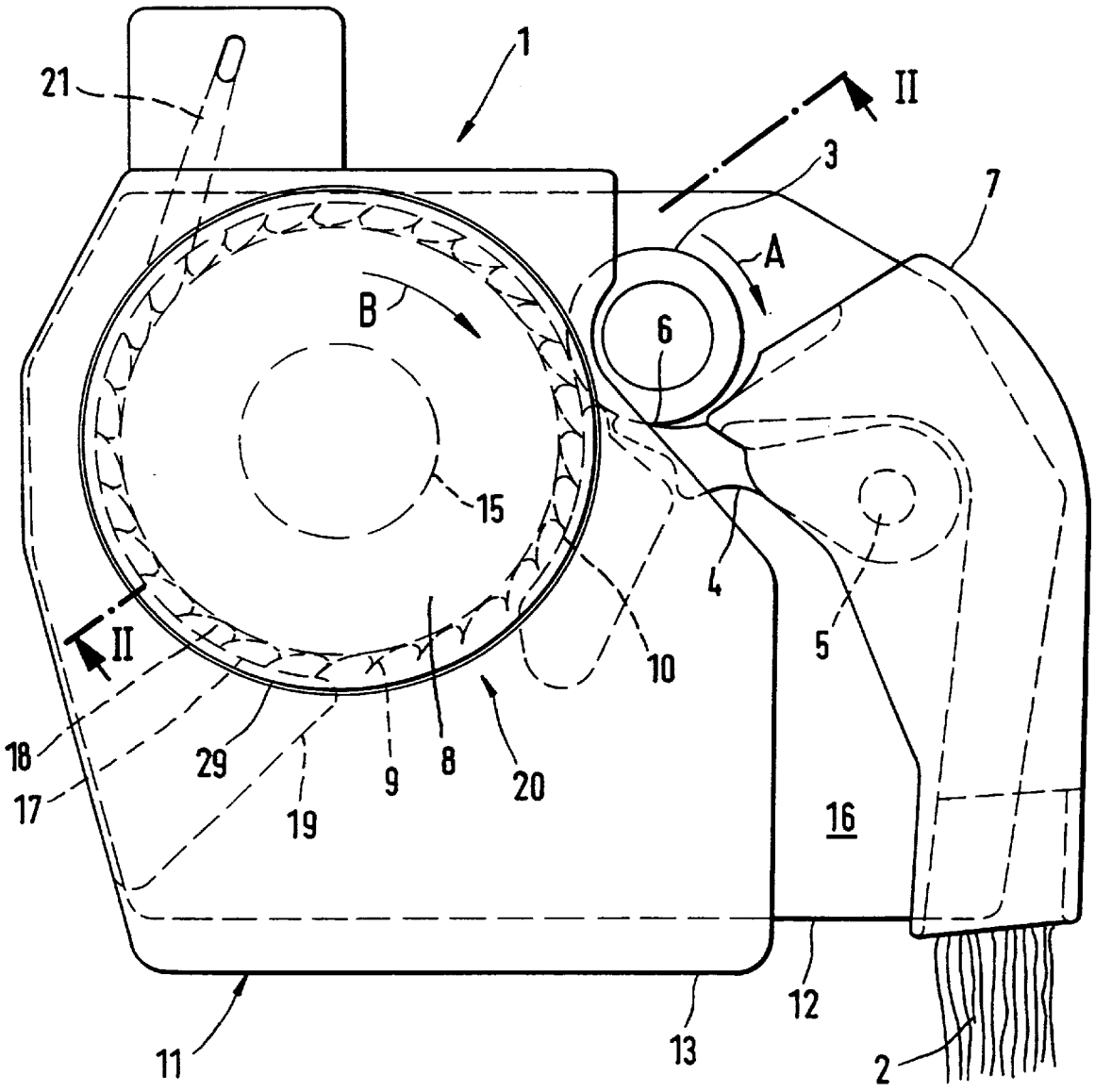
FIG. 1 is a schematic side view of an opening device according to the present invention, as seen from the operational side of the open-end spinning machine.
Figure 2:
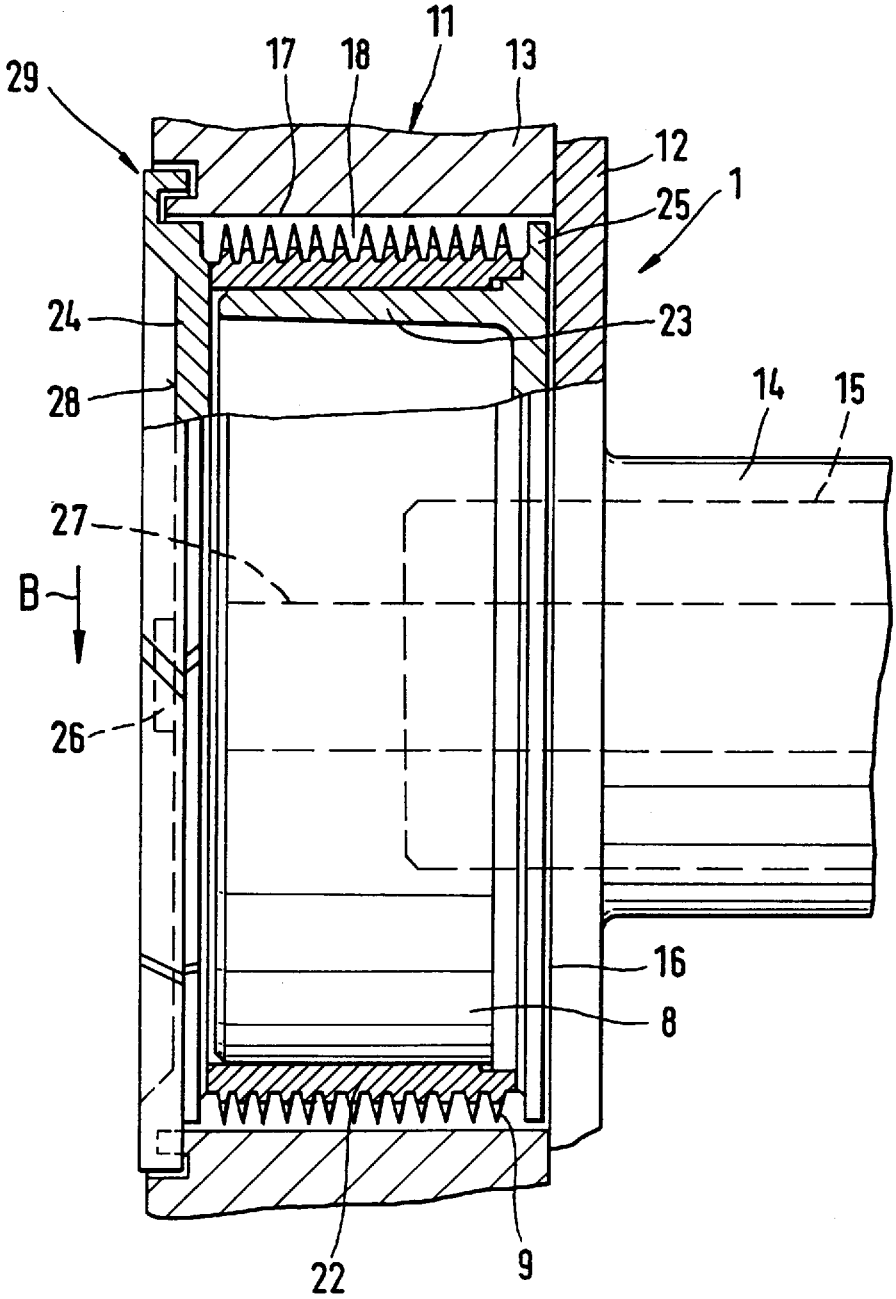
FIG. 2 is a somewhat enlarged longitudinal section of the opening device along the section surface II—II of FIG. 1.

The opening device 1 as shown in FIGS. 1 and 2 is in a known way a component of an open-end spinning arrangement (not shown). The opening device 1 serves to feed a sliver 2 and to open it into single fibers. For this purpose, a feed roller 3 is provided which is driven in rotational direction A and against which a feed table 4 can be flexibly pressed from below. The feed table 4 can be swivelled around a swivel axle 5 and loaded against the feed roller 3 by means of a loading spring (not shown). A nipping line is thus formed between the feed roller 3 and the feed table 4, against which nipping line 6 the sliver 2 is wedged during transport. A feed condenser 7 for the sliver 2 is arranged upstream of the feed roller 3.

The feed roller 3 supplies the sliver 2 to be opened into single fibers to a significantly faster driven opening roller 8, which is driven in the same rotational direction B as the feed roller 3. The opening roller 8 is provided in a known way with a combing structure 9, which can comprise, for example, saw teeth or needles or the like.

Between the feed table 4 and the opening roller 8 a fiber beard support 10 is stationarily arranged, which presses the end of the sliver 2 to be opened, the so-called fiber beard, into the combing structure 9 of the opening roller 8 from the back side.

The above mentioned components are supported on a housing 11, which essentially comprises two part housings 12 and 13.

The part housing 12 serves in a way not shown to fix the entire housing 11 to a holding device of the open-end spinning arrangement and furthermore to support the bearing of the opening roller 8. The part housing 12 is provided for this with a cylindrical receiver 14 for a bearing housing 15 of the opening roller 8. The part housing 12 comprises further a plane supporting surface 16, on which the part housing 13 is supported in a way not shown.

The second part housing 13 serves essentially the peripheral covering of the opening roller 8 and comprises for this purpose at least one peripheral surface 17, which surrounds the opening roller 8 over a part of its periphery while forming an annular clearance 18. Furthermore, guiding surfaces 19 are applied to the part housing 13, for example for defining a known trash removal opening 20.

The fiber feed channel 21 begins in the housing 11, which fiber feed channel 21 feeds the single fibers from the combing structure 9 of the opening roller 8 to a twist device (not shown), preferably a spinning rotor. The spinning rotor and thus the annular clearance 18 is connected to a vacuum supply which serves the transport of the single fibers.

The opening roller 8 comprises an exchangeable ring 22 which comprises the combing structure 9 and which is slid onto a base body 23 of the opening roller 8. A tension disc 24 serves to fix the ring 22 to the base body 23, which tension disc 24 is fixed to a shaft 27 of the opening roller 8 by means of a screw 26 and which tensions the ring 22 against a flange 25 of the base body 23.

The front side 28 of the opening roller 8 facing away from the part housing 12 is not covered by a lid and is thus exposed to the open atmosphere. In order to seal off the annular clearance 18 with its prevailing vacuum, the tension disk 24 of the opening roller 8 is sealed off from the part housing 13 by means of labyrinth seal 29 which will be described below.

Although a vacuum prevails in the annular clearance 18, the single fibers transported with the combing structure 9 have the tendency to enter the inside of the labyrinth seal 29. This must be prevented by the following measures. Furthermore, as experience has shown, there is fly in the area of the front side 28 of every opening roller 8 during operation of the open-end spinning machine, which fly also tends to enter the labyrinth seal 29 and block up same. This too is prevented in the manner described below.

The measures for holding off fly from the labyrinth seal 29 are described in more detail below with the aid of greatly enlarged representations in FIGS. 3 and 4.

A first sealing gap 30 of the labyrinth seal 29 takes the form of an annular gap and begins at the annular clearance 18 in the area of the outer diameter of the combing structure 9. The first sealing gap 30 extends in axial direction of the opening roller 8. A further, second sealing gap 31 can also be seen, which also takes the form of an annular gap extending in axial direction of the opening roller 8 and which is at a distance from the first sealing gap 30. The second sealing gap 31 is exposed to the open atmosphere.

The first sealing gap 30 is formed between a first cylindrical collar surface 32 which rotates in rotational direction B of the opening roller 8 and a hollow cylindrical countersurface 34 of the part housing 13 of the housing 11. In a similar way, the second sealing gap 31 is formed between a second cylindrical collar surface 33 of the opening roller 8 and a hollow cylindrical countersurface 35 of the part housing 13.

Although the labyrinth seal 29 is in a position to prevent a disturbance in the air conditions in the annular clearance 18, without the measures described below, however, it is not possible to prevent fly from entering the inside of the labyrinth seal 29 from the annular clearance 18 through the first sealing gap 30 and from the open atmosphere through the second sealing gap 31 and thus blocking the inside of the labyrinth seal 29 to such an extent that the rotation of the opening roller 8 is impaired. For this reason, fly-repulsing notches 36 and 37 are provided in connection with the labyrinth seal 29, which notches 36 and 37 are applied to the collar surfaces 32 and 33 in the form of grooves extending diagonally to the rotational direction B of the opening roller 8.

The fly-repulsing notches 36, preferably three or four in number, are applied to the first cylindrical collar surface 32 and have a direction of effect C, which is directed towards the combing structure 9 and thus towards the annular clearance 8. The flyrepulsing notches 37, again three or four in number, which are applied to the second cylindrical collar 33, have a direction of effect D, which is directed towards the open atmosphere. The notches 36 and 37 have each striker surfaces 38 or 39, which extend radially towards the opening roller 8 and are arranged on the side of the notches 36 and 37 facing away from the rotational direction B. The striker surfaces 38 and 39 serve as a mechanical structure to repulse the fly away from the labyrinth seal 29.

Figure 3:
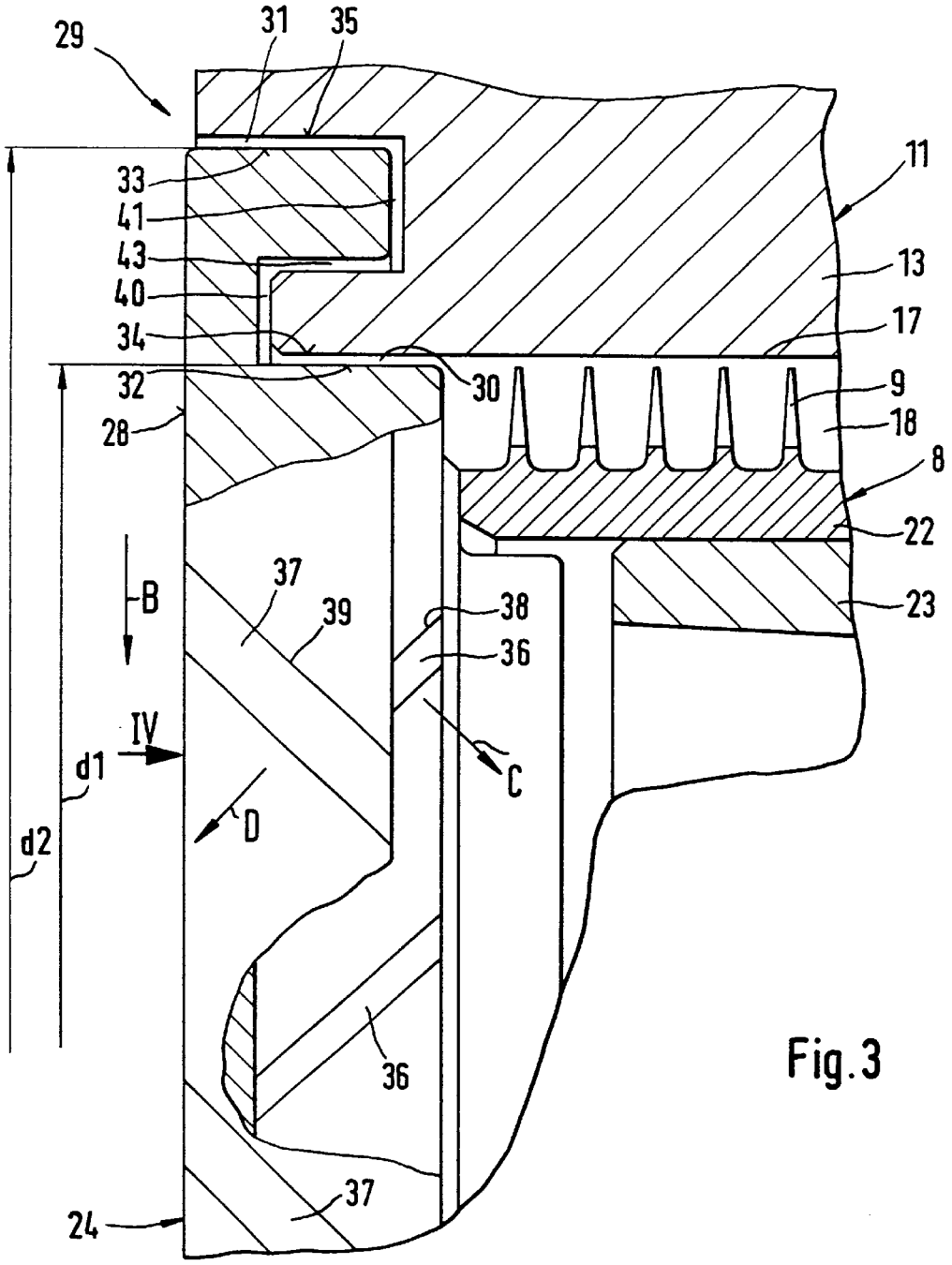
FIG. 3 is a part view, greatly enlarged, of FIG. 2 in the area of the labyrinth seal.
Figure 4:
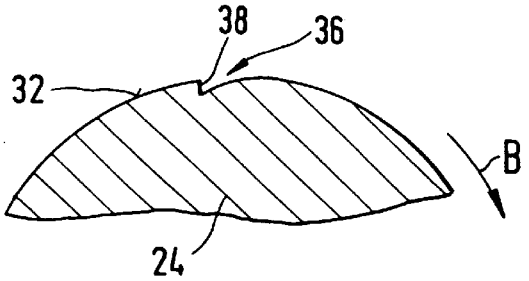
FIG. 4 is a view in the direction of arrow IV of FIG. 3 of a fly-repulsing notch.

As can be seen further from FIG. 3, the first cylindrical collar surface 32 and the second cylindrical collar surface 33 have different diameters $d_1$ and $d_2$, and are thus disposed in radial direction of the opening roller 8 more or less over one another. This means that the first sealing gap 30 and the second sealing gap 31 do not need to be displaced in relation to one another in axial direction of the opening roller 8, whereby the labyrinth seal 29 can be kept shorter in axial direction. In addition, the number of deflections inside the labyrinth seal 29 is hereby increased, which results in a better sealing effect.

The first and second sealing gaps 30 and 31 set at a distance from one another are connected by means of radially extending intermediary gaps 40 and 41, as well as by a third annular sealing gap 43.

The first and second cylindrical collar surfaces 32 and 33 are arranged on the same component, which can be disassembled from the opening roller 8, in the case of the present invention this component being the tension disk 24. Thus should a cleaning of the interior of the labyrinth seal 29 be necessary despite the measures according to the present invention, the labyrinth seal 29 can easily be taken apart and cleaned by disassembling the tension disk 24.

Figure 5:
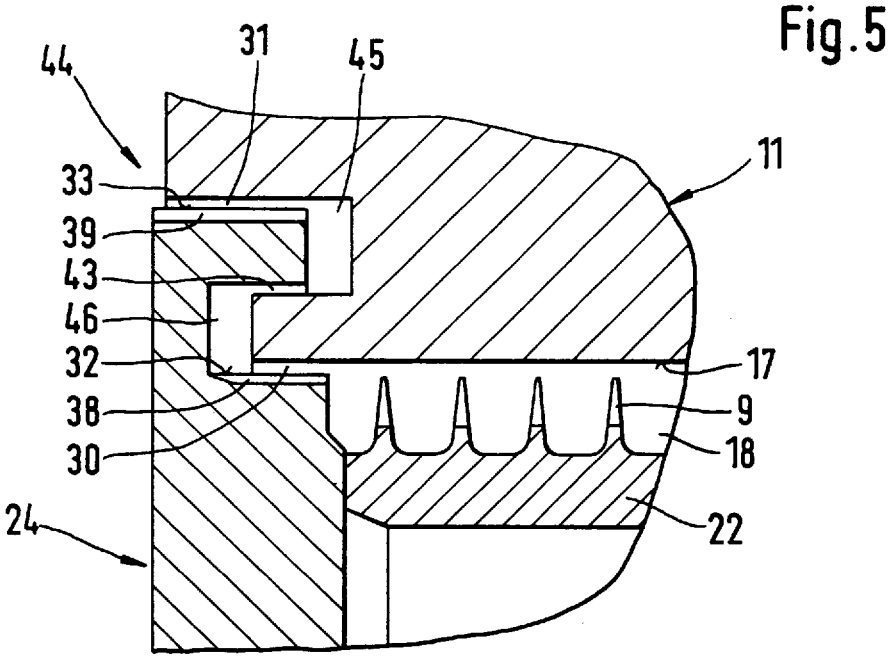
FIGS. 5 and 6 are each a part view similar to FIG. 3, but with somewhat reduced dimensions, of further embodiments of the labyrinth seal.

The embodiment according to FIG. 5 corresponds to a large extent to the embodiment according to FIG. 3, but with the difference that in FIG. 5 a labyrinth seal 44 is provided whereby the radially extending intermediary gaps 40 and 41 of FIG. 3 are replaced by expansion chambers 45 and 46. These expansion chambers 45 and 46 take the form of annular chambers, which separate the first sealing gap 30 and the second sealing gap 31 from one another and which annular chambers are wider in axial direction than the radially extending intermediary gaps 40 and 41 described above. Due to the increase in cross section of the expansion chambers 45 and 46! the air speed which prevails in the second sealing gap 31 and in the annular sealing gap 43, is for the most part destroyed by eddies and throttle effect, whereby the sealing effect of the labyrinth seal 44 is increased. No appreciable amount of air can then penetrate through the sealing gap 30 into the annular clearance 18. The fly-repulsing notches 36 and 37 are of course also present in this embodiment.

Figure 6:
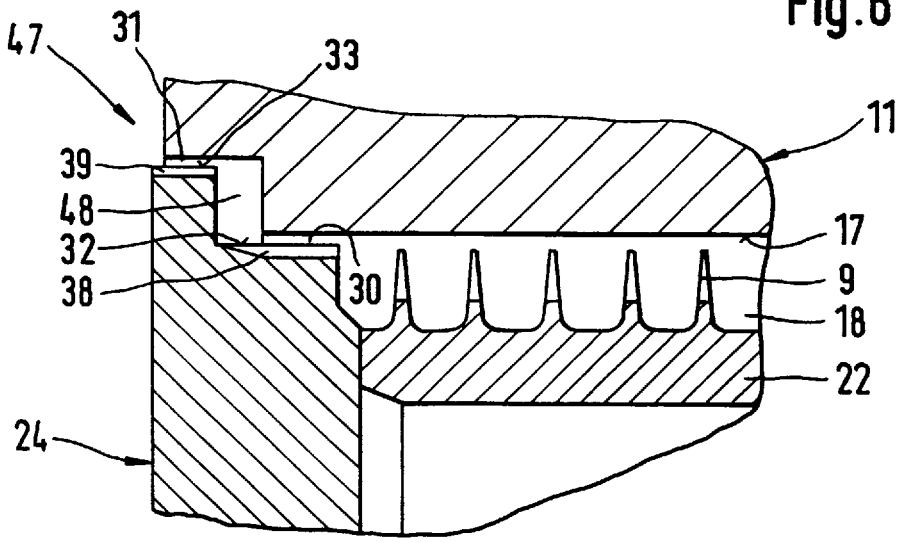

The embodiment in FIG. 6 shows a labyrinth seal 47, which at a first observation corresponds to the prior art mentioned above, in which a first sealing gap 30 is connected to a second sealing gap 31 by means of an expansion chamber 48. Differing from this prior art, however, the first cylindrical collar surface 32 as well as the second cylindrical collar surface 33 are each provided with fly-repulsing notches 36 or 37, whose direction of effect is directed away from the labyrinth seal 47, that is, either towards the annular clearance 18 or towards the open atmosphere.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An opening device for an open-end spinning machine comprising an opening roller which rotates in a housing to which a vacuum is applied a labyrinth seal being provided for sealing off the interior of said housing from a front side exposed to the open atmosphere, said labyrinth seal beginning in the area of a peripheral combing structure of the opening roller with a first sealing gap in the form of an annular clearance, and being connected to the open atmosphere by a second sealing gap in the form of an annular clearance which is arranged at a distance from the first sealing gap, whereby these sealing gaps are formed by first and second cylindrical collar surfaces of the opening roller and corresponding hollow cylindrical countersurfaces of the housing, wherein the first collar surface arranged at the first sealing gap and the second collar surface arranged at the second sealing gap are provided with fly-repulsing notches which mechanically act on the fly and whose direction of effect are each directed away from the labyrinth seal.

2. An opening device according to claim 1, wherein the direction of effect of the notches of the first collar surface is directed towards the combing structure and the direction of effect of the notches of the second collar surface is directed towards the open atmosphere.

3. An opening device according to claim 2, wherein the notches are in the form of grooves extending diagonally to an in use rotational direction of the opening roller.

4. An opening device according, to claim 3, wherein the notches are each provided on a side facing away from the rotational direction each with a fly-repulsing strike surface extending radially towards the opening roller.

5. An opening device according to claim 4, wherein the first and second collar surfaces comprising the notches have different diameters.

6. An opening device according to claim 4, wherein the first and second sealing gaps are separated by at least one expansion chamber in the form of an annular chamber.

7. An opening device according to claim 4, wherein the first and second collar surface are arranged on a single component, which is separable from the opening roller.

8. An opening device according to claim 3, wherein the first and second collar surfaces comprising the notches have different diameters.

9. An opening device according to claim 3, wherein the first and second sealing gaps are separated by at least one expansion chamber in the form of an annular chamber.

10. An opening device according to claim 2, wherein the first and second collar surfaces comprising the notches have different diameters.

11. An opening device according to claim 10, wherein the first and second sealing gaps are at the same axial location with respect to the opening roller.

12. An opening device according to claim 10, wherein the first and second collar surface are arranged on a single component, which is separable from the opening roller.

13. An opening device according to claim 2, wherein the first and second sealing gaps are separated by at least one expansion chamber in the form of an annular chamber.

14. An opening device according to claim 2, wherein the first and second collar surface are arranged on a single component, which is separable from the opening roller.

15. An opening device according to claim 1, wherein the first and second sealing gaps are separated by at least one expansion chamber in the form of an annular chamber.

16. An opening device according to claim 15, wherein the first and second sealing gaps are at the same axial location with respect to the opening roller.

17. An opening device according to claim 15, wherein the first and second collar surface are arranged on a single component, which is separable from the opening roller.

18. An opening device according to claim 1, wherein the first and second collar surface are arranged on a single component, which is separable from the opening roller.

* * * * *